US005345210A

United States Patent [19]

Swensen et al.

[11] Patent Number: 5,345,210

[45] Date of Patent: Sep. 6, 1994

[54] TIME DELAY FUSE

[75] Inventors: Robert G. Swensen, Mt. Prospect; Joseph W. Kowalik, Skokie, both of Ill.

[73] Assignee: Littelfuse, Inc., Des Plaines, Ill.

[21] Appl. No.: 94,376

[22] Filed: Jul. 19, 1993

[51] Int. Cl.[5] ..... H01H 85/04

[52] U.S. Cl. ..... 337/163; 337/166

[58] Field of Search ..... 337/163, 164, 165, 166, 337/234, 236, 238, 239

[56] References Cited

U.S. PATENT DOCUMENTS 4,533,895 8/1985 Kowalik et al. .

4,636,765 1/1987 Krueger .

*Primary Examiner*—Lincoln Donovan

*Attorney, Agent, or Firm*—Wallenstein, Wagner & Hattis, Ltd.

[57] ABSTRACT

A time delay fuse and various subassembly components for that time delay fuse. The fuse includes a housing made of an insulating material. The housing encloses a short-circuit fusible element, preferably a copper or copper alloy strip having a plurality of slots. The housing also encloses one or more rigid meltable fusible elements, preferably a plurality of solder bars. A body of resilient, compressible insulating material has at least one passageway through which each of the time delay fusible elements extends. When the rigid meltable fusible elements melt, the circuit through the fuse opens. In addition, the passageway which surrounded the rigid meltable fusible elements collapses upon its melting. This provides protection against "arc-back."

16 Claims, 3 Drawing Sheets

TIME DELAY FUSE

DESCRIPTION

1. Technical Field

This invention relates to an improved time delay fuse. In particular, this invention is related to a component for a time delay fuse, which component includes both a solder link and a copper or copper alloy fusible link. These links open upon prolonged overload and short-circuit conditions.

2. Background Of The Invention

Time delay fuses are well known in the fuse industry. One example of a typical time delay fuse is the Class R fuse described and claimed in U.S. Pat. No. 4,533,895 ('895 patent), issued to Joseph W. Kowalik et al. on Aug. 6, 1985. The '895 patent, which is assigned to the assignee of the present application, describes a slow blowing or time delay fuse having one or more conducting fuse links for short-circuit blowout protection. Typically, the short-circuit blowout protecting fuse links are located at opposite longitudinal ends of the fuse in individual end chambers. These individual end chambers are contained and defined by a cup-shaped end cap 6 or 6' and a washer 18 or 18'. See FIGS. 2, 3 and 10 of the '895 patent. Each of these individual end chambers is filled with an arc-quenching filler, such as sand. The washer 18 and 18' prevents sand from entering a central compartment or chamber 23.

The end chambers provide short-circuit blowout protection. In contrast, the central compartment or chamber 23 provides a more massive fuse link structure which provides blowout protection for prolonged, but relatively low, current overload. This more massive fuse link structure is shown in some detail in FIGS. 2 and 7–10 of the '895 patent. The structure includes a plunger 14, a plunger guide member 16, and a conically-shaped compressed coil spring 17. This compressed coil spring 17 bears upon an upper flat surface of the plunger 14. The plunger 14 also includes a plunger extension 14c (FIGS. 7 and 11C) which contacts one of the high-current fuse links 12, and is secured to that link 12 with a solder connection 20B (FIG. 9). An additional solder connection 20C secures one end of the plunger guide member 16 to plunger member 14.

Junctions 20B and 20C melt under prolonged, modest (i.e., 135 percent) overload current conditions lasting for a given minimum period of time. Particularly, heat developed in the short-circuit protection strips 12 flows through the plunger 14 and guide member 16. The plunger 14 and plunger guide member 16 act as heat sinks, and gradually soften and melt the solder junctions 20B and 20C. The tendency of the spring 17 to expand places a force on the solder junction 20C. Ultimately, as a result, this spring force will propel the plunger 14 down over the plunger guide member 16. This action separates the plunger member 14 from the short-circuit protection strip 12, as shown in FIG. 10.

The fuse shown and described in the '895 patent is generally reliable, and has been used commercially with success over a period of many years. The construction of this fuse, however, is expensive for many reasons. First, in order to ensure smooth and reliable operation of the plunger 14 and its related components, the sand in the end chambers must be kept out of the central compartment 23 with tight fitting, close tolerance washers 18 and 18' (FIGS. 2 and 3).

Second, the spring 17, plunger 14 and plunger guide member 16 have substantial mass and must be aligned properly. Such alignment is not difficult to ensure, but requires additional steps in the manufacturing process. These steps are important. As may be appreciated from the embodiment shown in FIG. 10, the failure to properly align these elements can prevent, under overload conditions, the plunger from smoothly sliding over the plunger guide member 16. Such failure could, in turn, prevent the normal separation of the plunger extension 14c from the current heatable strip 12. If this were to occur, the fuse may not provide its designed-in overload protection for the protected circuit.

SUMMARY OF THE INVENTION

The invention is a time delay fuse and various subassembly components for that time delay fuse. The fuse itself includes a housing which is typically made of an insulating material. First and second conductive terminals are secured to and emerge from the opposite axial ends of this housing.

The housing encloses a short-circuit fusible element. This short-circuit fusible element, preferably a copper or copper alloy strip, includes first and second opposite ends. This first opposite end is conductively connected to the first conductive terminal of the housing.

The housing also encloses a time delay fusible element. This time delay fusible element is conductively secured between the second end of the short-circuit fusible element and the second terminal of the housing. Preferably, the time delay fusible element and short-circuit fusible element are longitudinally-spaced, and extend along a first longitudinal axis of the housing. This time delay fusible element melts to interrupt current flow when overload current flows through the time delay fusible element for a given period of time.

A body of resilient, compressible insulating material includes a passageway through which the time delay fusible element extends. This passageway is defined by surrounding walls. Upon melting of the time delay fusible element, these walls collapse because of the resiliency of the insulating material.

Solder bars that are a component of the time delay fusible element include a pair of end portions and a central portion between these end portions. The central portions of the solder bars are retained within the passageway of the body of insulating material, while the end portions of the solder bars project axially beyond the insulating body.

The housing of the present fuse may be entirely filled with a pulverulent arc-quenching material. Preferably, that pulverulent arc-quenching material is sand.

Objects of this invention include a new fuse, such as a Class R fuse, which may have a single interior chamber. A still further object of the invention is a time delay fuse whose interior chamber may be safely and entirely filled with a pulverulent arc-quenching material, such as sand. Another object of the invention is a time delay fuse having no moving parts and lower mass than prior art time delay fuses.

Another object is a time delay fuse which does not include relatively slidable moving parts. The elimination of such relatively sliding parts removes the potential for misalignment of those parts, and lessens the possibility that the fuse may fail to open the protected circuit upon overload conditions.

A still further object of the invention is a single Class R time delay fuse which provides full 600 volt alternating current and 600 volt direct current protection. Another object of the invention is a time delay fuse in which one may more easily increase current ratings in a more compact fuse.

DETAILED DESCRIPTION OF THE PREFERRED EMBODIMENT

The invention is a time delay fuse and various subassembly components for that time delay fuse.

Figure 1:
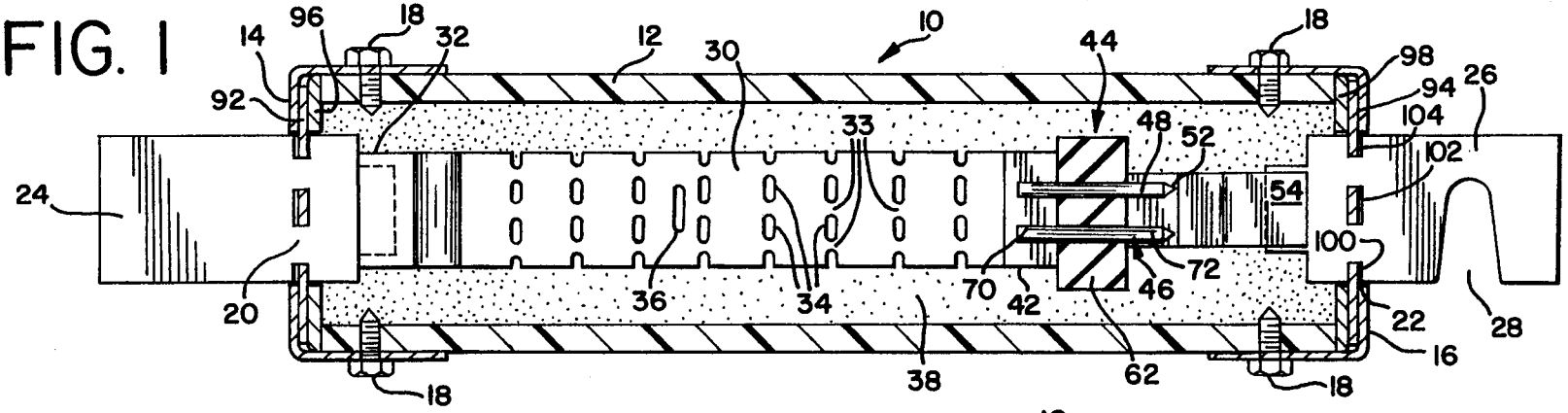
FIG. 1 is a side, cutaway view of a preferred embodiment of a time delay fuse of the invention, and showing its subcomponents.
Figure 2:
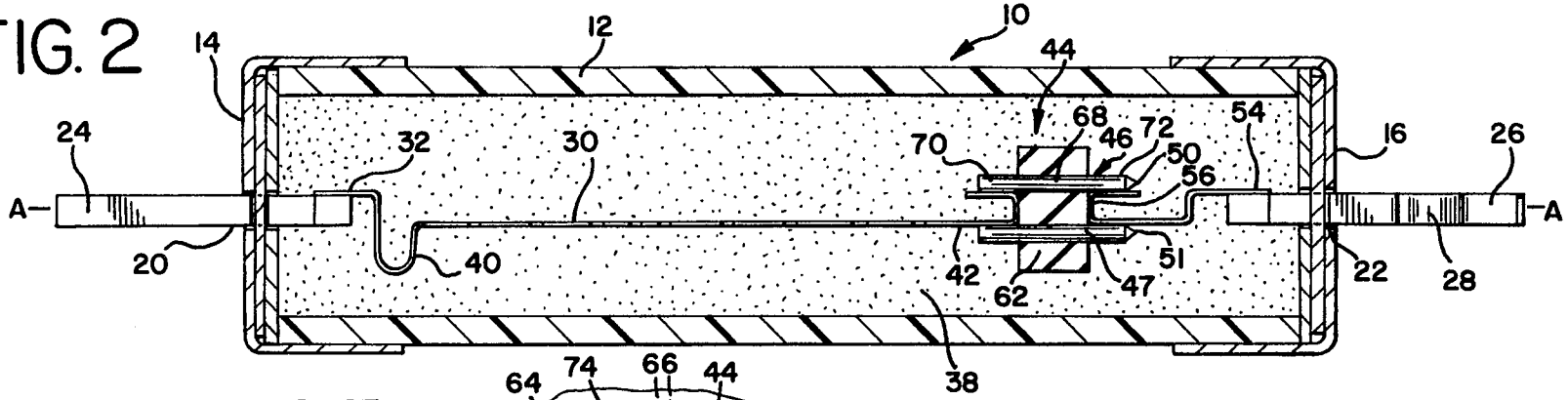
FIG. 2 is a view of the fuse of FIG. 1, but with the fuse turned 90° about its longitudinal axis.

The blade-type terminal fuse 10 and various elements and subassembly components of that fuse 10 are shown in greater detail in FIGS. 1–5. FIGS. 1 and 2 show the initially open-ended cylindrical housing 12 of the fuse 10, which housing 12 is made of a suitable, conventional insulating material. Secured over the initially open ends of the housing 12 are a pair of cup-shaped end caps 14 and 16. End caps 14 and 16 are secured in place upon the housing by four screws 18. Apertures 20 and 22 are provided in the ends of end caps 14 and 16. Through these apertures 20 and 22 project a first 24 and a second 26 knife-blade terminal. These terminals 24 and 26 are secured to and emerge from the opposite axial ends of this housing 12. As can be seen from FIG. 1, the second or normally upwardly-positioned terminal 26 includes a cutout 28 typically used for locating and securing Class R fuses. The housing 12 of the present invention and, in fact, all of the above-described, externally visible components are like those shown in FIG. 1 of U.S. Pat. No. 4,533,895.

These terminals 24 and 26 are secured to a subassembly. This subassembly, which is enclosed in the housing 12, includes a short-circuit fusible element 30. This short-circuit fusible element 30, preferably a copper or copper alloy strip, includes first 32 and second opposite ends. If the short-circuit fusible element 30 is made of a copper alloy strip, then the preferred copper alloy is an alloy of nickel-copper or zinc-copper. The first opposite end 32 is conductively connected, as by welding or soldering, to a side face of first conductive terminal 24.

The short-circuit fusible element 30 includes elongated slots 34 (FIG. 1) which form current flow restrictions in the element 30. The combination of these slots 34 and the adjacent, remaining solid portion of the element form what are commonly known as bridges 33. A single, somewhat larger elongated slot 36 is positioned near the center of the short-circuit fusible element 30. This larger elongated slot 36, along with the closest conventional slots 34, increase the resistance at a central zone of the short-circuit fusible element 30 to a level above that of any other portion of the element 30. As a result, there is an increased likelihood of the fuse blowing in this central zone of the short-circuit fusible element 30. This is desirable, as any arc formed in this central zone upon blowing of the element 30 must then travel the longest possible distance before reaching either of the terminals 24 and 26. That fact increases the likelihood that the arc will be quenched prior to reaching terminals 24 or 26. In this embodiment, quenching is facilitated by an arc-quenching material, preferably a pulverulent material and, most preferably, common silica sand 38.

As can best be seen in FIG. 2, the short-circuit fusible element 30 includes a J-shaped portion 40 at its first opposite end 32, and a C-shaped portion 42. The purpose of this J-shaped portion 40 is to provide stress relief for the short-circuit fusible element 30 during assembly and transport of the fuse. Such stress can occur due to stretching of the element 30. This stretching can be attributable to (a) variations in the lengths of the short-circuit element 30; or (b) variations in the points at which that element 30 is either (1) welded or soldered to the first terminal 24, or (2) secured to four solder bars 46-49. Placing this J-shaped portion 40 in element 30 eliminates this stress and prevents stress-related malfunction of the short-circuit element 30.

The J-shaped portion also provides for a greater effective length of element in a relatively confined space. This provides additional protection against burn-back. The J-shaped portion 40 provides a barrier, reducing the likelihood that any arc formed in the center of the fuse reaches first conductive terminal 24.

The C-shaped portion 42 ensures good mechanical and electrical contact with another component portion, i.e., the solder bars 46-49, of this fuse 10.

The housing 12 also encloses a time delay fusible element 44. This time delay fusible element 44 is conductively secured between the C-shaped portion 42 of the short-circuit fusible element 30 and the second terminal 26 of the housing 12. Preferably, the time delay fusible element 44 and short-circuit fusible element 30 are longitudinally-spaced and extend along a first longitudinal axis "A" of the housing (FIG. 2).

Figure 3:
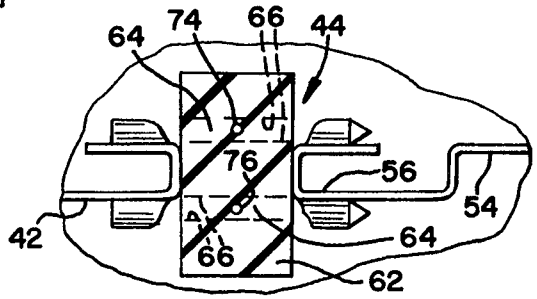
FIG. 3 is an enlarged view of a portion of FIG. 2, and particularly of the time delay fusible element in the housing, including a body of resilient, compressible insulating material, after the time delay fusible element has blown.

This time delay fusible element 44 comprises one or more rigid meltable fusible elements, such as a body of solder 46. In this embodiment, which is preferred, and as may best be seen in FIG. 5, second 47, third 48 and fourth bodies of solder 49 are also provided. These first 46, second 47, third 48 and fourth 49 bodies of solder are generally cylindrical in shape, and each has a cone-shaped end 50, 51, 52 and 53. The cone-shaped ends come to a point, facilitating insertion of the solder into the body of resilient, compressible insulating material. As shown in FIGS. 2 and 3, the noncone-shaped ends of solder bodies 46, 47, 48 and 49 are soldered or spot-welded to the C-shaped portion 42 of short-circuit fusible element 30. The materials for these solder bodies can vary, but the preferred materials include 51.2 percent tin, 30.6 percent lead and 18.2 percent cadmium solid wire solder, or 63 percent tin and 37 percent lead solid wire solder.

The portions of the solder bodies 46, 47, 48 and 49 adjacent cone-shaped ends 50, 51, 52 and 53 are also secured by soldering or spot-welding to a C-shaped portion 56 of a copper strip 54. As may be seen in FIG. 1, this strip 54 or heater element is somewhat narrower and appreciably shorter than short-circuit fusible element 30. Moreover, this heater element 54 does not include any slots 36. Thus, short-circuit overloads are not likely to result in blowing of this copper heater element 54.

Heater element 54 could optionally include slots, but with these slots this heater element 54 would not open, under any conditions, prior to the blowing of short-circuit element 30. Slots in a heater element 54 would increase resistance at the so-called slot point. As a result, a heater element 54 with slots could generate greater amounts of heat, and would open only under short-circuit conditions.

As discussed above and as shown in FIGS. 2 and 5, the portion of solder bodies 46, 47, 48 and 49 adjacent cone-shaped ends 50, 51, 52 and 53 are soldered or spot-welded to a C-shaped portion 56 of copper heater element 54. Securement of the solder bodies in this manner ensures that there is good physical and electrical contact between those bodies 46, 47, 48 and 49 and the copper heater element 54. To complete the circuit through this fuse 10, the end of heater element 54 opposite this C-shaped portion 56 is soldered or spot-welded to second terminal 26.

Figure 5:
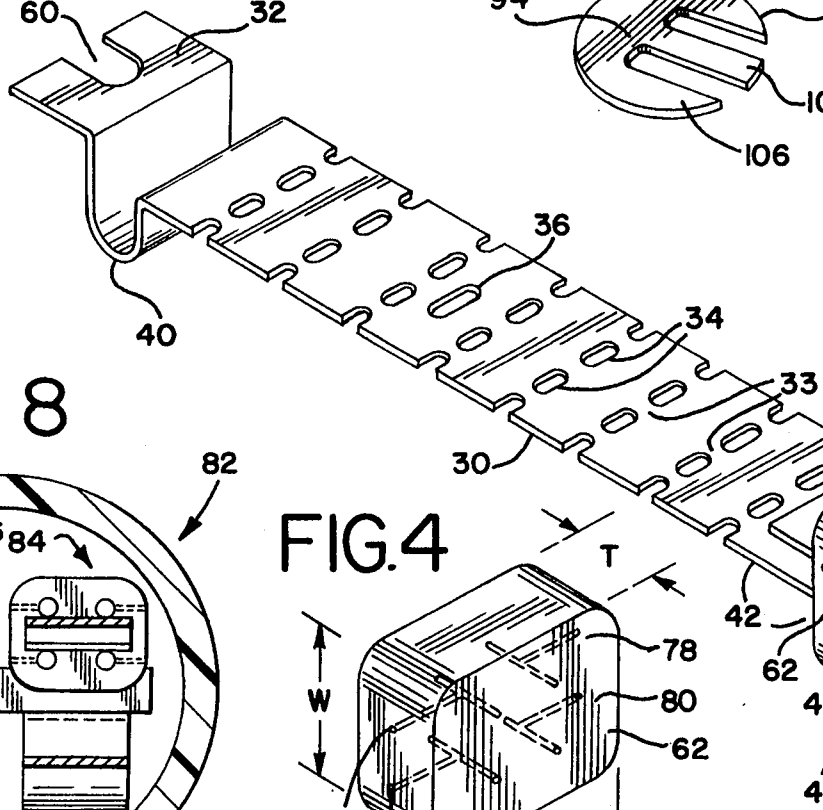
FIG. 5 is a perspective view of the fusible components of the fuse of FIG. 1 and, in particular, showing all four solder bars in the preferred time delay fusible element.

As may be seen in FIG. 5, both this copper strip/-heater element 54 and the short-circuit element 30 include a notch 58 and 60, respectively. Notches 58 and 60 are preferred only for fuses rated between 110–600 amperes.

As explained above, the time delay fusible element 44 includes solder bodies 46, 47, 48 and 49. This time delay fusible element 44 also includes a body 62 of resilient, compressible insulating material. The compressible insulating material may be an elastomer. The preferred elastomer is a silicone rubber with a durometer hardness of 10.

In this specification, the term "compressible" is intended to refer to a material which may collapse upon and obscure any relatively small openings which are formed in a block of that material. Particularly, for the purposes of this invention, a compressible material is one in which (1) a relatively small hole may be formed with a hole-forming instrument; and (2) when the hole-forming instrument is removed from that hole, the surrounding compressible material will collapse upon and obscure that hole.

This specification gives certain preferred dimensions for components of the fuses in accordance with the invention. The dimensions stated are suitable for fuses rated at between 70 and 600 amperes.

Figure 4:
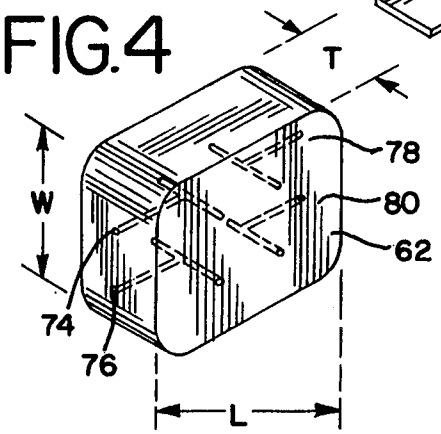
FIG. 4 is an enlarged perspective view of the body of resilient, compressible insulating material shown in FIGS. 1–3, but without the solder bars normally contained within that material.

FIG. 4 shows a preferred body 62 of resilient, compressible insulating material. In this embodiment, the material has a length (L) of 0.750 inches, a width (W) of 0.650 inches and a thickness (T) of 0.375 inches. Four holes, each having a diameter of 0.030 inches, are molded into the 0.375 inch thickness of the body 62. As may be appreciated from a review of FIGS. 1, 2, 5 and especially 3, this molding forms four passageways 64 through which the time delay fusible elements 46, 47, 48 and 49 extend. Each of these passageways 64 are defined by surrounding walls 66.

Upon melting of the solder bars 46, 47, 48 and 49, in the manner shown in FIG. 3, these walls 66 collapse because of the resiliency of the body 62 of silicone rubber insulating material. In this manner, as may be seen in FIG. 4, passageway 64 is virtually completely obscured, leaving visible only four small points where the hole-forming instrument entered the body 62. The complete closing of these passageways 64 is not necessary to effect interruption of the circuit in the fuse 10. Interruption of the circuit in the fuse 10 occurs when these solder bars 46,47, 48 and 49 melt. The closing of the passageway 64, however, aids in preventing arcs formed during the designed-in failure of the fuse from a condition known as "arc-back," i.e., the movement of an arc through the length of the fuse. Protection against such "arc-back" is also provided by two other sources: (1) the sand 38, which acts as an arc quencher; and (2) the body 62 of silicone rubber insulating material, which acts as a physical arc barrier within the fuse.

FIGS. 3, 4 and 5 show four elongated vent holes 74, 76, 78 and 80. These vent holes have a diameter of 0.110 inches, and are drilled or punched into the body 62 of insulating material. These vent holes 74, 76, 78 and 80 begin at the outer periphery of the body 62, and move inwardly towards the solder bars 46, 47, 48 and 49, respectively. Vent holes 74, 76, 78 and 80 provide for pressure relief by permitting an escape path for the molten solder from the solder bars. Particularly, any molten solder can move outwardly from the site of the bars through any one of the vent holes 74, 76, 78 and 80 into the arc-quenching or pulverulent material which, in this embodiment, is sand 38. After drilling, these vent holes also collapse because of the resiliency of the body 62 of silicone rubber insulating material. Vent holes 74, 76, 78 and 80, however, would open under appropriate circumstances to provide the above-described pressure relief for the escape of molten solder.

As may best be seen in FIGS. 1, 2 and 5, the solder bars 46, 47, 48 and 49 of the time delay fusible element 44 include a pair of end portions and a central portion between these end portions. In FIGS. 1 and 2, the end and central portions of solder bar 46 are shown. The central portion 68 of the solder bar 46 is retained within the passageway 64 of the body 62 of insulating material, while the end portions 70 and 72 of the solder bar 46 project axially beyond the insulating body 62. In this embodiment, each solder bar 46, 47, 48 and 49 has an overall length of 0.906 inches and a diameter of 0.120 inches. Of this 0.906 inch length, 0.835 inches is a completely cylindrical portion, while the cone-shaped end portion 50 measures 0.071 inches in length. The angle of the surface of the cone-shaped end portion, relative to the horizontal, is approximately 40°.

As may be seen from FIGS. 2 and 3, it is important that C-shaped portions 42 and 56 touch the body 62 of resilient, compressible insulating material.

Figure 9:
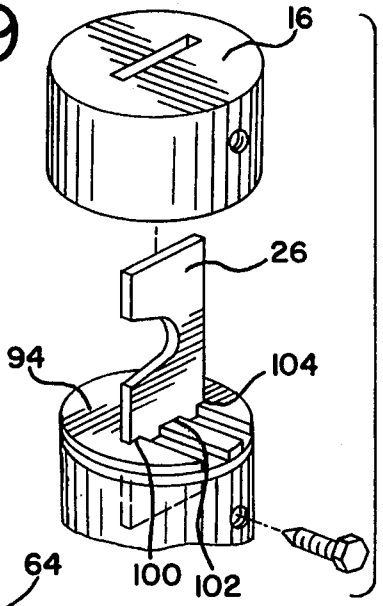
FIG. 9 is a partial exploded view of the fuse of FIG. 1, showing the end cap removed from the body of the fuse.
Figure 10:
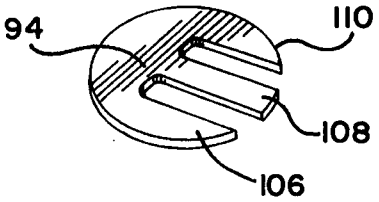
FIG. 10 is a perspective view of an E-clip used to stabilize a portion of the fuse of FIG. 9.

FIGS. 9 and 10 show a component of the fuse which provides stability to first 24 and second 26 knife blade terminals. The elements providing such stability are the so-called E-rings 92 and 94. The E-rings 92 and 94 are respectively positioned between end caps 14 and 16 and slotted flat washers 96 and 98. FIG. 1 shows three slots 100, 102 and 104 in terminal blade 26. The remaining terminal blade 24 and the terminal blades shown in the embodiment of FIGS. 6 and 7 also include such slots.

The legs of the E-ring 106, 108 and 110 project through slots 100, 102 and 104 in terminal blade 26. When the end cap 16 is placed onto the fuse housing 12 and tightly screwed into place, the E-ring 94 tightly secures the terminal blade 26 in its place. In this manner, the terminal blade will not wobble from side to side during use.

Figure 8:
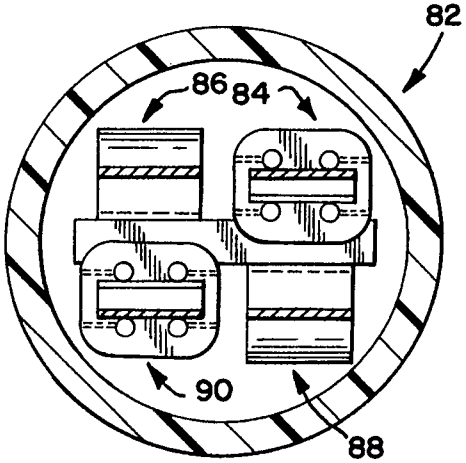
FIG. 8 is a sectional view of a portion of the fuse of FIG. 7, and taken along lines 8—8 of FIG. 7.
Figure 6:
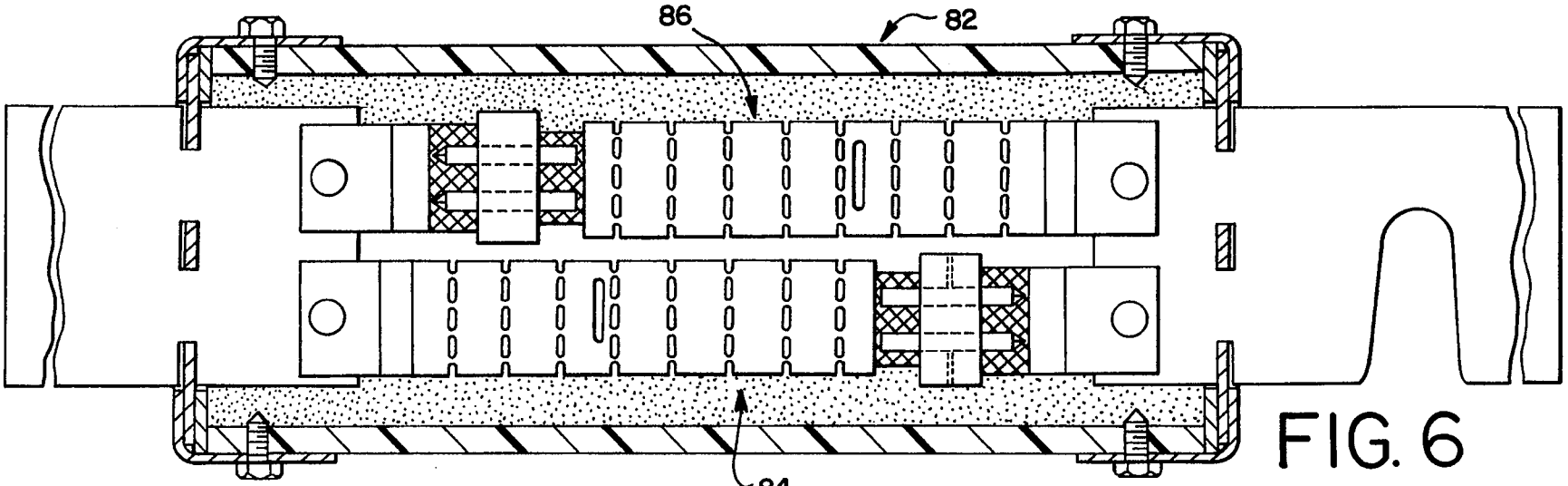
FIG. 6 is a side cutaway view of another preferred embodiment of the invention.
Figure 7:
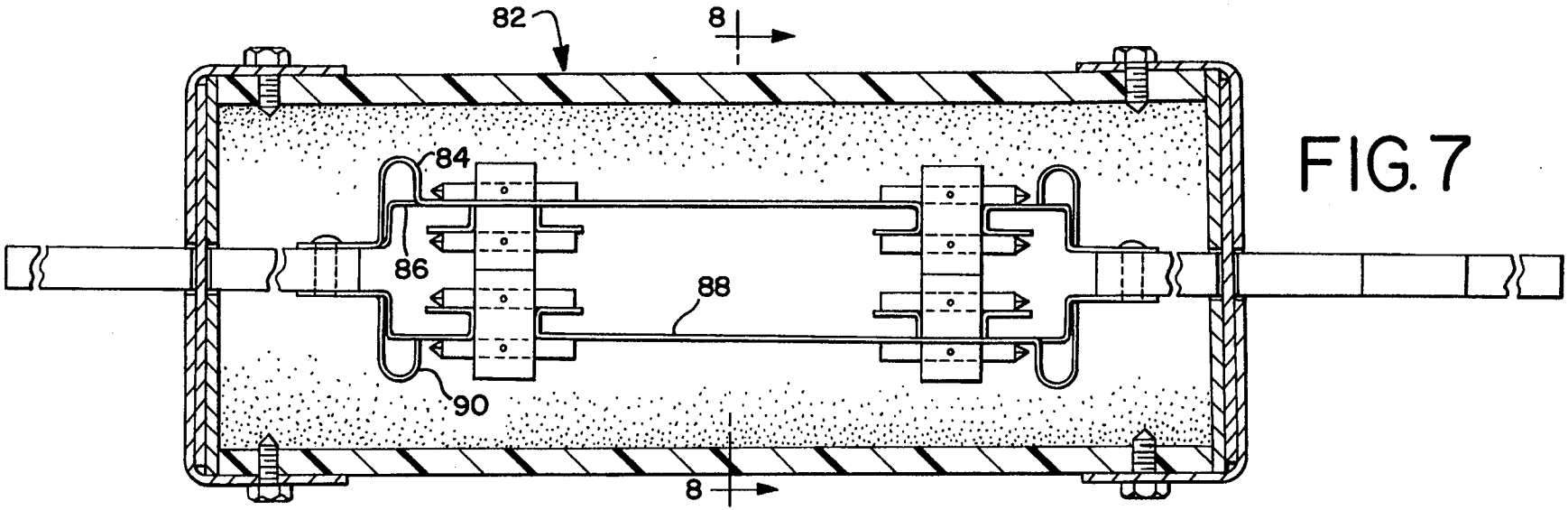
FIG. 7 is a view of the fuse of FIG. 6, but turned 90° about its longitudinal axis.

FIGS. 6–8 show fuses generally like that shown in FIGS. 1–5, but with a significant difference. The fuses shown in FIGS. 1–5 include a single subassembly between opposite terminals 24 and 26. The fuses of FIGS. 6–8 have a plurality of parallel subassemblies between such opposite fuse terminals. For example, FIGS. 6–8 depict a fuse 82 having four parallel subassemblies 84, 86, 88, 90 arrayed about the axis of that fuse. By including more than one subassembly in a fuse of this type, the current rating of that fuse can be increased roughly in proportion to the number of subassemblies added. Particularly, one fuse in accordance with the present invention and having one subassembly may be rated at 100 amperes. If four of these same subassemblies were arrayed in parallel in an appropriately larger-sized fuse body, then the rating of the fuse would increase from 100 to approximately 400 amperes.

The construction described above has resulted in a new standard in Class R fuses. Particularly, this Class R fuse has been rated at 600 volts alternating current and 600 volts direct current. Prior Class R fuses had ratings of 600 volts alternating current, but only 300 volts direct current.

Objects attained by this invention include a new time delay fuse which may have a single interior chamber. Another attained object of this invention is a time delay fuse having lower cycle fatigue. A still further attained object of the invention is a time delay fuse whose interior chamber may be safely and entirely filled with a pulverulent arc-quenching material, such as sand. Another attained object of the invention is a time delay fuse having no moving parts and lower mass than prior art time delay fuses.

A further object is a time delay fuse which does not include relatively slidable parts. The elimination of such relatively slidable parts removes the potential for misalignment of those parts, with its attendant potential hazard that an overload condition may not lead to an opening of the circuit by the fuse.

While the specific embodiments have been illustrated and described, numerous modifications come to mind without markedly departing from the spirit of the invention. The scope of protection is, thus, only intended to be limited by the scope of the accompanying claims.

What I claim is:

1. A subassembly component for mounting within the housing of a time delay fuse, said subassembly component for mounting between the axial ends of said fuse, said subassembly component comprising:

a. a rigid meltable fusible element having a pair of ends and said rigid meltable fusible element melting upon exposure to a current overload for a given period of time; and b. a body of resilient, compressible insulating material spaced apart from conductive terminals of said fuse, said body having a passageway through which a portion of said rigid meltable fusible element extends, and said passageway being defined by surrounding walls, said walls collapsing upon the melting of said rigid meltable fusible element due to the resiliency of said body of material.

2. The subassembly component of claim 1, wherein said rigid meltable fusible element expands said walls of said passageway to accommodate said rigid meltable fusible element, and wherein when said current overload flows through said rigid meltable fusible element for said given period of time, said rigid meltable fusible element melts to effect collapse of said passageway.

3. A subassembly component for a time delay fuse, said subassembly component comprising:

a. a rigid meltable fusible element having a pair of ends, said ends being securable to spaced-apart conductive terminals of an electrical circuit, and said rigid meltable fusible element melting upon exposure to a current overload for a given period of time; and b. a body of resilient, compressible insulating material, said body having a passageway through which a portion of said rigid meltable fusible element extends, and said passageway being defined by surrounding walls, said rigid meltable fusible element expanding said walls of said passageway to accommodate said rigid meltable fusible element, said walls collapsing upon the melting of said rigid meltable fusible element when said current overload flows through said rigid meltable fusible element for said given period of time, due to the resiliency of said body of material, said body of material further comprising vent holes to provide any molten portions of said rigid meltable fusible element with an escape path.

4. A time delay fuse, comprising:

a. a housing with first and second conductive terminals at the opposite axial ends of said housing;

b. a short-circuit fusible element within said housing, said short-circuit fusible element having first and second opposite ends, said first opposite end being conductively connected to said first terminal;

c. a rigid meltable fusible element in said housing, said rigid meltable fusible element being conductively secured between said second end of said short-circuit fusible element and said second terminal; and d. a body of resilient, compressible insulating material, said body having a passageway through which said rigid meltable fusible element extends, said passageway being defined by surrounding walls, and said walls collapsing because of the resiliency of said insulating material upon melting of said rigid meltable fusible element.

5. The time delay fuse of claim 4, wherein said rigid meltable fusible element extends along a first longitudinal axis, and includes a pair of end portions and a central portion between said end portions, said central portion of said rigid meltable fusible element being retained within said passageway of said body of insulating material, and the end portions of said time delay fusible element projecting axially beyond said body.

6. The time delay fuse of claim 5, wherein said short-circuit fusible member is a thin copper strip or copper alloy strip, and where said rigid meltable fusible element melts to interrupt current flow when overload current flows through said rigid meltable fusible element for a given period of time.

7. The time delay fuse of claim 6, wherein said rigid meltable fusible element and said short-circuit fusible element are longitudinally-spaced and extend along a first longitudinal axis of said housing.

8. The time delay fuse of claim 4, wherein said housing encloses a quantity of a pulverulent arcquenching material.

9. The time delay fuse of claim 8, wherein said pulverulent arc-quenching material is sand.

10. The time delay fuse of claim 4, further comprising a heater element connecting said rigid meltable fusible element with said second conductive terminal.

11. The time delay fuse of claim 4, wherein said body of resilient, compressible insulating material includes vent holes to provide any molten portions of the initially rigid meltable fusible element with an escape path.

12. A component for a time delay fuse, said component comprising:

a. a short-circuit fusible element that is heatable and fusible by short-circuit current;

b. a rigid meltable fusible element that is electrically connected to one end of said short-circuit fusible element, said rigid meltable fusible element comprising at least one body of solder conductively secured to said short-circuit fusible element; and c. a body of resilient, compressible insulating material collapsed around said rigid meltable fusible element, a collapsible passageway within said resilient body being defined by said body of solder;

the walls of said passageway collapsing to form an arc and current barrier when said body of solder melts.

13. The component for a time delay fuse as set forth in claim 12, wherein said short-circuit fusible element is a copper or copper alloy strip.

14. The component for a time delay fuse as set forth in claim 13, wherein said copper or copper alloy strip forming said short-circuit fusible element includes at least one elongated slot and at least one enlarged elongated slot along its length, said portion of said short-circuit fusible element adjacent said elongated and said enlarged elongated slots providing increased resistance to current flow, to encourage blowing of said short-circuit fusible element adjacent said enlarged elongated slots upon short-circuit or high overload current conditions.

15. A time delay fuse having a housing with first and second conductive terminals at the opposite axial ends of said housing, and a subassembly for said time delay fuse, said subassembly including:

a. at least a pair of laterally-spaced, axially-extending rigid meltable fusible elements that are heatable and fusible by modest overload electrical current over a given time;

b. a short-circuit fusible element that is disposed between one end of said pair of rigid meltable fusible elements and said first terminal; and c. a body of resilient, compressible insulating material collapsed around said pair of rigid meltable fusible elements, a collapsible passageway being defined by said rigid meltable fusible elements and by passageway walls in the insulating material;

the walls of said passageway collapsing to form an arc and current barrier when said rigid meltable fusible elements melt.

16. The time delay fuse of claim 15, further comprising a heater element connecting said rigid meltable fusible element with said second conductive terminal.

* * * * *